US006579829B2

(12) United States Patent
Nishimura et al.

(10) Patent No.: US 6,579,829 B2
(45) Date of Patent: Jun. 17, 2003

(54) DEVELOPER COMPOSITION AND HEAT SENSITIVE RECORDING MATERIAL

(75) Inventors: Takeshi Nishimura, Fukuoka (JP); Masaru Wada, Fukuoka (JP); Masayuki Furuya, Fukuoka (JP); Junya Tanaka, Fukuoka (JP)

(73) Assignee: Mitsui Chemicals, Inc., Tokyo (JP)

( * ) Notice: Subject to any disclaimer, the term of this patent is extended or adjusted under 35 U.S.C. 154(b) by 120 days.

(21) Appl. No.: 09/817,416

(22) Filed: Mar. 27, 2001

(65) Prior Publication Data

US 2001/0036903 A1 Nov. 1, 2001

(30) Foreign Application Priority Data

Mar. 27, 2000 (JP) ..... 2000-085665

(51) Int. Cl.[7] ..... B41M 5/30; B41M 5/32
(52) U.S. Cl. ..... 503/216; 106/31.18; 427/150
(58) Field of Search ..... 503/216; 427/150; 106/31.18

(56) References Cited

FOREIGN PATENT DOCUMENTS

JP HEI 8-2697 * 3/2000
JP HEI 2-25354 * 8/2000
JP HEI 5-13071 * 10/2000

* cited by examiner

*Primary Examiner*—B. Hamilton Hess
(74) *Attorney, Agent, or Firm*—Burns, Doane, Swecker & Mathis, LLP

(57) ABSTRACT

The invention is a novel developer composition which comprises one or more phenol derivative of sulfonamide structure represented by the formula (1) and one or more constituents selected from a polyvalent metal compound, antioxidant and reducing agent and provides dispersion having excellent preservation stability on atomization in water. The heat sensitive recording material comprising the developer composition has high color density in developed image and is also excellent in whiteness degree before recording.

(1)

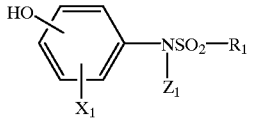

wherein $X_1$ is a hydrogen or halogen atom, an alkyl, alkoxy or hydroxyl group, $Z_1$ is a hydrogen atom or alkyl group, and $R_1$ is an unsubstituted or substituted alkyl or aryl group.

31 Claims, No Drawings

DEVELOPER COMPOSITION AND HEAT SENSITIVE RECORDING MATERIAL

BACKGROUND OF THE INVENTION

1. Field of the Invention

The present invention relates to a developer composition and a heat-sensitive recording material containing the same.

2. Prior Art of the Invention

Conventionally, heat-sensitive recording materials utilizing a coloration reaction of an electron donative, color forming compound with an electron acceptor compound (developer) have been well know, for example, in Japanese Patent SHO 43-4160 and 45-14039. Heat sensitive recording materials are less expensive and recording equipment has an advantage of compactness and maintenance-free, and thus the recording system is widely used in the field of a facsimile machine, recorder and printer. Recently, the application field of heat sensitive recording materials has been further extended and diversified, and spreaded out into uses under more harsh environments such as labels and prepaid cards.

However, when conventionally known 2,2-bis(4'-hydroxyphenyl)propane ("bisphenol A") or benzyl 4-hydroxybenzoate is used for the electron acceptor compound, the resultant heat sensitive recording material cannot give satisfactory color concentration in high speed recording or has disadvantages that undeveloped portions are remarkably stained (soil) or developed images are faded under harsh environments, for example, in contact with oil, solvent, fat, fluorescent pens and other writing tools, or in high humidity surroundings.

In recent years, 2,2-bis(4'-hydroxyphenyl)propane ("bisphenol A") which has been most commonly used for a developer due to a low price is pointed out problems on safety in view of environmental hormone.

Under such conditions, a heat sensitive recording material (heat sensitive recorder) which uses a phenol derivative having a sulfonamide structure has been proposed as an electron acceptor compound having excellent color concentration and additional improvements on the above disadvantages, for example, in Japan Patent HEI 2-25354, 5-13071 and 8-2697.

The phenol derivative having the sulfonamide structure is an electron acceptor compound exerting very excellent properties. However, it has been found that the atomized aqueous dispersion of the phenol derivative is lacking in stability and leads to coloration and that the heat sensitive recording material prepared from the aqueous dispersion is disadvantageous in a low degree of whiteness on the undeveloped portion before recording.

Consequently, it has been strongly demanded to improve these drawbacks without eliminating the excellent properties of the phenol derivative having the sulfonamide structure and to develop a phenol derivative having a sulfonamide structure and a heat sensitive recording material using said electron acceptor compound which have improved stability of aqueous dispersion and increased whiteness of the undeveloped portion.

SUMMARY OF THE INVENTION

The object of the present invention is to provide a novel developer composition (particularly a developer composition for a heat sensitive recording material) which comprises a phenol derivative having a sulfonamide structure and is excellent in preservation stability of the atomized aqueous dispersion, and further to provide a heat sensitive recording material which is prepared from the developer composition, has a high color concentration, and is also excellent in whiteness before recording.

As a result of an intensive investigation in order to realize the above demands, the present inventors have found that an excellent heat sensitive recording material can be obtained by using an electron accepting developer composition comprising one or more constituents selected from the compound represented by the formula (1) and one or more constituents selected from a polyvalent metal compound, antioxidant and reducing agent. Thus the present invention has been completed.

That is, the aspects of the invention are illustrated by the items below.

1) A developer composition comprising one or more compounds represented by the formula (1)

(1)

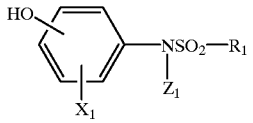

wherein X1 is a hydrogen or halogen atom, an alkyl, alkoxy or hydroxyl group, Z1 is a hydrogen atom or alkyl group, and R1 is an unsubstituted or substituted alkyl or aryl group, and one or more constituents selected from a polyvalent metal compound. antioxidant and reducing agent.

2) A developer composition according to item 1 wherein the composition comprises 0.1 to 5 parts by weight of one or more constituents selected from a polyvalent metal compound, antioxidant and reducing agent for 100 parts by weight of one or more compounds represented by the formula (1).

3) A developer composition comprising one or more compounds represented by the formula (1) and one or more constituents selected from a polyvalent metal compound.

4) A developer composition according to item 3 wherein the composition comprises 0.1 to 5 parts by weight of one or more constituents selected from a polyvalent metal compound for 100 parts by weight of one or more compounds represented by the formula (1).

5) A developer composition according to one of item 1 to item 4 wherein the polyvalent metal compound is zinc sulfate.

6) A heat sensitive recording material equipped on a carrier with a heat sensitive recording layer comprising an electron donative, color forming compound and an electron acceptor compound wherein said electron acceptor compound is a developer composition according to one of item 1 to item 5.

7) A heat sensitive recording material according to item 6 wherein the heat sensitive recording layer comprises additionally a heat fusible compound.

8) A heat sensitive recording material according to item 6 or item 7 wherein the heat sensitive recording layer comprises additionally an ultraviolet absorber.

9) A heat sensitive recording material according to one of item 6 to item 8 wherein the heat sensitive recording layer comprises additionally a hindered phenol compound.

10) A heat sensitive recording material according to one of item 6 to item 9 wherein the heat sensitive recording layer comprises additionally a binder.

11) A heat sensitive recording material according to one of item 6 to item 10 wherein the heat sensitive recording layer comprises additionally a pigment.

12) A heat sensitive recording material according to item 11 wherein the pigment has oil absorption of 50 ml/100 g or more in accordance with JIS K-5101.

13) A heat sensitive recording material according to one of item 6 to item 12 wherein an under-coat layer is additionally installed between the carrier and the heat sensitive recording layer.

14) An aqueous dispersion obtained by atomized aqueous dispersing of the developer composition according to one of item 1 to item 5.

The invention can provide a novel developer composition which comprises a phenol derivative having a sulfonamide structure and is excellent in preservation stability of the atomized aqueous dispersion and further can provide a heat sensitive recording material which is prepared from the developer composition, has a high color concentration and is also excellent in whiteness before recording.

PREFERRED EMBODIMENT OF THE INVENTION

The present invention will hereinafter be illustrated further in detail.

The representative developer compositions which can be used in the invention include compositions comprising one or more compounds represented by the formula (1) and one or more constituents selected from a polyvalent metal compound, antioxidant and reducing agent.

(1)

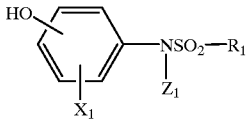

wherein $X_1$ is a hydrogen or halogen atom, an alkyl, alkoxy or hydroxyl group, $Z_1$ is a hydrogen atom or alkyl group, and $R_1$ is an unsubstituted or substituted alkyl or aryl group.

In the compound represented by the formula (1), $X_1$ is a hydrogen or halogen atom, an alkyl, alkoxy or hydroxyl group, preferably a hydrogen or halogen atom, for example, fluorine, chlorine or bromine atom, a $C_1$ to $C_6$ alkyl group, for example, methyl, ethyl, n-propyl, isopropyl, n-butyl, isobutyl, tert-butyl, n-pentyl, n-hexyl, cyclopentyl or cyclohexyl group, a $C_1$ to $C_6$ alkoxy group, for example, methoxy, ethoxy, n-propoxy, n-butoxy, iso-butoxy, n-pentyloxy, n-hexyloxy or cyclohexyloxy group, or a hydroxyl group. In these substituents, a hydrogen atom, halogen atom and $C_1$ to $C_4$ alkyl group are more preferred. A hydrogen atom is most preferred.

In the compound represented by the formula (1), $Z_1$ is a hydrogen atom or alkyl group, preferably a hydrogen atom, a $C_1$ to $C_6$ alkyl group, for example, methyl, ethyl, n-propyl, isopropyl, n-butyl, isobutyl, tert-butyl, n-pentyl, n-hexyl, cyclopentyl or cyclohexyl group, more preferably a hydrogen atom.

In the compound represented by the formula (1), $R_1$ is an unsubstituted or substituted alkyl or aryl group, preferably a $C_1$ to $C_6$ alkyl group, for example, methyl, ethyl, n-propyl, isopropyl, n-butyl, isobutyl, tert-butyl, n-pentyl, n-hexyl, cyclopentyl or cyclohexyl group, or a $C_6$ to $C_{10}$ aryl group, for example, phenyl, 4-methylphenyl, 3-methylphenyl, 2-methylphenyl, 4-ethylphenyl, 3-ethylphenyl, 4-n-propylphenyl, 4-isopropylphenyl, 4-n-butylphenyl, 4-sec-butylphenyl, 4-tert-butylphenyl, 4-methoxyphenyl, 3-methoxyphenyl, 2-methoxyphenyl, 4-ethoxyphenyl, 4-isopropoxyphenyl, 4-n-butoxyphenyl,4-fluorophenyl, 3-fluorophenyl, 4-chlorophenyl, 3-chlorophenyl, 2-chlorophenyl, 4-chloro-2-methylphenyl, 4-chloro-3-methylphenyl, 2,4-dimethylphenyl, 2,5-dimethylphenyl, 3,4-dimethylphenyl, 2,4-dichlorophenyl, 2,5-dichlorophenyl, 2-methoxy-4-methylphenyl, 2-methyl-4-methoxyphenyl, 2,4-dimethoxyphenyl, 3,4-dimethoxyphenyl, 3,5-diethoxyphenyl, 1-naphthyl or 2-naphthyl group.

Specific examples of the compound represented by the formula (1) include following compounds. However, these exemplified compounds are not to be construed to limit the scope of the invention.

| Number | Compound |
|---|---|
| 1-1 | N-butyl-N-(4-hydroxyphenyl)methanesulfonamide |
| 1-2 | N-(4-hydroxyphenyl)ethanesulfonamide |
| 1-3 | N-methyl-N-(4-hydroxyphenyl)ethanesulfonamide |
| 1-4 | N-ethyl-N-(4-hydroxyphenyl)ethanesulfonamide |
| 1-5 | N-butyl-N-(4-hydroxyphenyl)ethanesulfonamide |
| 1-6 | N-methyl-N-(3-hydroxyphenyl)ethanesulfonamide |
| 1-7 | N-methyl-N-(4-hydroxyphenyl)-2-propanesulfonamide |
| 1-8 | N-methyl-N-(3-hydroxyphenyl)-2-propanesulfonamide |
| 1-9 | N-methyl-N-(4-hydroxyphenyl)butanesulfonamide |
| 1-10 | N-methyl-N-(3-hydroxyphenyl)butanesulfonamide |
| 1-11 | N-ethyl-N-(4-hydroxyphenyl)butanesulfonamide |
| 1-12 | N-ethyl-N-(3-hydroxyphenyl)butanesulfonamide |
| 1-13 | N-butyl-N-(4-hydroxyphenyl)butanesulfonamide |
| 1-14 | N-butyl-N-(3-hydroxyphenyl)butanesulfonamide |
| 1-15 | N-(4-hydroxyphenyl)butanesulfonamide |
| 1-16 | N-(3-hydroxyphenyl)butanesulfonamide |
| 1-17 | N-(4-hydroxyphenyl)hexanesulfonamide |
| 1-18 | N-(3-hydroxyphenyl)hexanesulfonamide |
| 1-19 | N-methyl-N-(4-hydroxyphenyl)hexanesulfonamide |
| 1-20 | N-ethyl-N-(4-hydroxyphenyl)hexanesulfonamide |
| 1-21 | N-butyl-N-(4-hydroxyphenyl)hexanesulfonamide |
| 1-22 | N-(4-hydroxyphenyl)benzenesulfonamide |
| 1-23 | N-(4-hydroxyphenyl)-(2'-methylbenzene)sulfonamide |
| 1-24 | N-(4-hydroxyphenyl)-(3'-methylbenzene)sulfonamide |
| 1-25 | N-(4-hydroxyphenyl)-(4'-methylbenzene)sulfonamide |
| 1-26 | N-(4-hydroxyphenyl)-(4'-ethylbenzene)sulfonamide |
| 1-27 | N-(4-hydroxyphenyl)-(4'-n-propylbenzene)sulfonamide |
| 1-28 | N-(4-hydroxyphenyl)-(4'-isopropylbenzene)sulfonamide |
| 1-29 | N-(4-hydroxyphenyl)-(4'-n-butylbenzene)sulfonamide |
| 1-30 | N-(4-hydroxyphenyl)-(4'-tert-butylbenzene)sulfonamide |
| 1-31 | N-(4-hydroxyphenyl)-(4'-n-pentylbenzene)sulfonamide |
| 1-32 | N-(4-hydroxyphenyl)-(4'-n-hexylbenzene)sulfonamide |
| 1-33 | N-(4-hydroxyphenyl)-(4'-cyclohexylbenzene)sulfonamide |
| 1-34 | N-(4-hydroxyphenyl)-(3',4'-dimethylbenzene)sulfonamide |
| 1-35 | N-(4-hydroxyphenyl)-(3'-methoxybenzene)sulfonamide |
| 1-36 | N-(4-hydroxyphenyl)-(4'-methoxybenzene)sulfonamide |
| 1-37 | N-(4-hydroxyphenyl)-(4'-ethoxybenzene)sulfonamide |
| 1-38 | N-(4-hydroxyphenyl)-(4'-isopropoxybenzene)sulfonamide |
| 1-39 | N-(4-hydroxyphenyl)-(4'-n-butoxybenzene)sulfonamide |
| 1-40 | N-(4-hydroxyphenyl)-(4'-n-pentyloxybenzene)sulfonamide |
| 1-41 | N-(4-hydroxyphenyl)-(4'-n-hexyloxybenzene)sulfonamide |
| 1-42 | N-(4-hydroxyphenyl)-(3'-fluorobenzene)sulfonamide |
| 1-43 | N-(4-hydroxyphenyl)-(4'-fluorobenzene)sulfonamide |
| 1-44 | N-(4-hydroxyphenyl)-(2'-chlorobenzene)sulfonamide |
| 1-45 | N-(4-hydroxyphenyl)-(3'-chlorobenzene)sulfonamide |
| 1-46 | N-(4-hydroxyphenyl)-(4'-chlorobenzene)sulfonamide |
| 1-47 | N-(4-hydroxyphenyl)-(4'-phenylbenzene)sulfonamide |
| 1-48 | N-(4-hydroxyphenyl)-(1'-naphthalene)sulfonamide |
| 1-49 | N-(4-hydroxyphenyl)-(2'-naphthalene)sulfonamide |
| 1-50 | N-(2-methyl-4-hydroxyphenyl)-(4'-methylbenzene)sulfonamide |
| 1-51 | N-(3-methyl-4-hydroxyphenyl)-(4'-chlorobenzene) sulfonamide |
| 1-52 | N-(3-methoxy-4-hydroxyphenyl)-(4'-chlorobenzene)sulfonamide |
| 1-53 | N-(2-chloro-4-hydroxyphenyl)benzenesulfonamide |
| 1-54 | N-(2,4-dihydroxyphenyl)benzenesulfonamide |
| 1-55 | N-(3,4-dihydroxyphenyl)-(4'-methylbenzene)sulfonamide |
| 1-56 | N-methyl-N-(4-hydroxyphenyl)benzenesulfonamide |
| 1-57 | N-methyl-N-(4-hydroxyphenyl)-(4'- |

-continued

| Number | Compound |
|---|---|
| | methylbenzene)sulfonamide |
| 1-58 | N-methyl-N-(4-hydroxyphenyl)-(4' chlorobenzene)sulfonamide |
| 1-59 | N-ethyl-N-(4-hydroxyphenyl)benzenesulfonamide |
| 1-60 | N-ethyl-N-(4-hydroxyphenyl)-(4'-methoxylbenzene)sulfonamide |
| 1-61 | N-n-propyl-N-(4-hydroxyphenyl)-(4'-methylbenzene)sulfonamide |
| 1-62 | N-n-butyl-N-(4-hydroxyphenyl)-(4'-methylbenzene)sulfonamide |
| 1-63 | N-ethyl-N-(4-hydroxyphenyl)-(4'-phenylbenzene)sulfonamide |
| 1-64 | N-methyl-N-(4-hydroxyphenyl)-(1'-naphthalene)sulfonamide |
| 1-65 | N-(3-hydroxyphenyl)benzenesulfonamide |
| 1-66 | N-(3-hydroxyphenyl)-(2'-methylbenzene)sulfonamide |
| 1-67 | N-(3-hydroxyphenyl)-(3'-methylbenzene)sulfonamide |
| 1-68 | N-(3-hydroxyphenyl)-(4'-methylbenzene)sulfonamide |
| 1-69 | N-(3-hydroxyphenyl)-(4'-ethylbenzene)sulfonamide |
| 1-70 | N-(3-hydroxyphenyl)-(4'-n-propylbenzene)sulfonamide |
| 1-71 | N-(3-hydroxyphenyl)-(4'-isopropylbenzene)sulfonamide |
| 1-72 | N-(3-hydroxyphenyl)-(4'-n-butylbenzene)sulfonamide |
| 1-73 | N-(3-hydroxyphenyl)-(4'-tert-butylbenzene)sulfonamide |
| 1-74 | N-(3-hydroxyphenyl)-(4'-n-pentylbenzene)sulfonamide |
| 1-75 | N-(3-hydroxyphenyl)-(4'-n-hexylbenzene)sulfonamide |
| 1-76 | N-(3-hydroxyphenyl)-(4'-cyclohexylbenzene)sulfonamide |
| 1-77 | N-(3-hydroxyphenyl)-(3',4'-dimethylbenzene)sulfonamide |
| 1-78 | N-(3-hydroxyphenyl)-(3'-methoxybenzene)sulfonamide |
| 1-79 | N-(3-hydroxyphenyl)-(4'-methoxybenzene)sulfonamide |
| 1-80 | N-(3-hydroxyphenyl)-(4'-ethoxybenzene)sulfonamide |
| 1-81 | N-(3-hydroxyphenyl)-(4'-isopropoxybenzene)sulfonamide |
| 1-82 | N-(3-hydroxyphenyl)-(4'-n-butoxybenzene)sulfonamide |
| 1-83 | N-(3-hydroxyphenyl)-(4'-n-pentyloxybenzene)sulfonamide |
| 1-84 | N-(3-hydroxyphenyl)-(4'-n-hexyloxybenzene)sulfonamide |
| 1-85 | N-(3-hydroxyphenyl)-(3'-fluorobenzene)sulfonamide |
| 1-86 | N-(3-hydroxyphenyl)-(4'-fluorobenzene)sulfonamide |
| 1-87 | N-(3-hydroxyphenyl)-(2'-chlorobenzene)sulfonamide |
| 1-88 | N-(3-hydroxyphenyl)-(3'-chlorobenzene)sulfonamide |
| 1-89 | N-(3-hydroxyphenyl)-(4'-chlorobenzene)sulfonamide |
| 1-90 | N-(3-hydroxyphenyl)-(4'-phenylbenzene)sulfonamide |
| 1-91 | N-(3-hydroxyphenyl)-(1'-naphthalene)sulfonamide |
| 1-92 | N-(3-hydroxyphenyl)-(2'-naphthalene)sulfonamide |
| 1-93 | N-(2-methyl-3-hydroxyphenyl)-(4'-methylbenzene)sulfonamide |
| 1-94 | N-(4-methyl-3-hydroxyphenyl)-(4'-chlorobenzene)sulfonamide |
| 1-95 | N-(5-methyl-3-hydroxyphenyl)-(4'-methylbenzene)sulfonamide |
| 1-96 | N-(4-methoxy-3-hydroxyphenyl)benzenesulfonamide |
| 1-97 | N-(5-chloro-3-hydroxyphenyl)benzenesulfonamide |
| 1-98 | N-(3,5-dihydroxyphenyl)benzenesulfonamide |
| 1-99 | N-(3,5-dihydroxyphenyl)-(4'-methylbenzene)sulfonamide |
| 1-100 | N-(3,5-dihydroxyphenyl)-(4'-chlorobenzene)sulfonamide |
| 1-101 | N-methyl-N-(3-hydroxyphenyl)benzenesulfonamide |
| 1-102 | N-methyl-N-(3-hydroxyphenyl)-(4' methylbenzene)sulfonamide |
| 1-103 | N-methyl-N-(3-hydroxyphenyl)-(4'-chlorobenzene)sulfonamide |
| 1-104 | N-ethyl-N-(3-hydroxyphenyl)benzenesulfonamide |
| 1-105 | N-ethyl-N-(3-hydroxyphenyl)-(4'-methoxybenzene)sulfonamide |
| 1-106 | N-n-propyl-N-(3-hydroxyphenyl)-(4'-ethylbenzene)sulfonamide |
| 1-107 | N-n-butyl-N-(3-hydroxyphenyl)-(4'-methylbenzene)sulfonamide |
| 1-108 | N-n-butyl-N-(3-hydroxyphenyl)-(4'-phenylbenzene)sulfonamide |
| 1-109 | N-(2-hydroxyphenyl)benzenesulfonamide |
| 1-110 | N-(2-hydroxyphenyl)-(4'-methylbenzene)sulfonamide |
| 1-111 | N-(2-hydroxyphenyl)-(4'-chlorobenzene)sulfonamide |
| 1-112 | N-(2-hydroxyphenyl)-(4'-methoxybenzene)sulfonamide |
| 1-113 | N-(4-methyl-2-hydroxyphenyl)benzenesulfonamide |
| 1-114 | N-(5-methoxy-2-hydroxyphenyl)-(4'-methoxybenzene)sulfonamide |
| 1-115 | N-methyl-N-(2-hydroxyphenyl)-(4'-methylbenzene)sulfonamide. |

The compound represented by the formula (1) in the invention can be prepared by known processes described in, for example, Japanese Laid Open Patent SHO 57-200340 and HEI 2-145560, and J, Orga. Chem., 19, 1708(1954).

That is, the compound can be prepared, for example, by reacting the compound represented by the formula (a) with the compound represented by the formula (b).

(a)

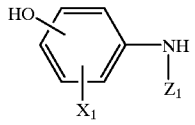

(b)

wherein $X_1$, $Z_1$ and $R_1$ are the same as defined in the formula (1), and $Y_1$ is a halogen atom.

Representative polyvalent metal compounds which can be used in the invention include, for example, zinc sulfate, magnesium sulfate, calcium sulfate, aluminum sulfate and other sulfates; zinc chloride, magnesium chloride, calcium chloride, barium chloride, nickel chloride, cobalt chloride, aluminum chloride and other chlorides; zinc acetate magnesium acetate and other acetates; and zinc nitrate and other nitrates.

Exemplary antioxidants which can be used in the invention include, for example, 2,6-diisopropyl-4-methylphenol, 2,6-di-tert-butyl-4-methylphenol, 2tert-butyl-4-methoxyphenol, 2,5-di-tert-octyl-4-methoxyphenol, 2,5-di-tert-butylhydroquinone, 2,5-di-tert-octylhydroquinone, 1,1,3-tris(2'-methyl-4'-hydroxy-5'-tert-butylphenyl)butane, 1,1,3-tris(2'-methyl-4'-hydroxy-5'-cyclohexylphenyl)butane, 1,1,3-tris(2'-ethyl-4'-hydroxy-5'-tert-butylphenyl)butane, 1,1,3-tris(3',5'-di-tert-butyl-4-hydroxyphenyl)butane, 1,1,3-tris(2'-methyl-4'-hydroxy-5'-tert-butylphenyl)propane, 1,1-bis(2'-methyl-5'-tert-butyl-4'-hydroxyphenyl)butane, tetrakis[methylene-3-(3',5'-di-tert-butyl-4'-hydroxyphenyl)propionate]methane, bis(3-tert-butyl-5-methyl-2-hydroxyphenyl)methane, bis(3-tert-butyl-5-ethyl-2-hydroxyphenyl)methane, 1,3,5-trimethyl-2,4,6-tris(3',5'-di-tert-butyl-4-hydroxybenzyl)benzene, 1,3,5-tris(4'tert-butyl-3'-hydroxy-2',6'-dimethylbenzyl)isocyanuric acid, 1,3,5-tris(4'-tert-butyl-3'hydroxy2'-methyl-6'-ethylbenzyl)isocyanuric acid, bis(2methyl-4-hydroxy-5-tert-butylphenyl)sulfide and other phenolic compounds;

2,2'-methylenebis(4"-methyl-6"-tert-butylphenyl)phosphate, 2,2'-methylenebis(4"-ethyl-6"-tert-butylphenyl)phosphate, 2,2'-methylene-bis(4",6"-di-tert-butylphenyl)phosphate, diphenyl phosphate, bis(4-tert-butylphenyl)phosphate, bis(2,4-di-tert-butylphenyl)phosphate, bis(4-chlorophenyl)phosphate, bis(2-phenylphenyl)phosphate, bis(4-phenylphenyl)phosphate and other phosphoric compounds and their metal salts such as potassium, sodium, zinc, calcium, magnesium and aluminum salts.

Reducing agent which can be used in the invention include, for example, sodium sulfite, sodium hydrogen sulfite, sodium sulfide, stannous chloride, sodium thiosulfate, sodium oxalate, calcium, magnesium and zinc.

The developer composition of the invention comprises one or more compounds represented by the formula(l) and one or more constituents selected from a polyvalent metal compound, antioxidant and reducing agent, and will hereinafter be referred to simply as developer composition A.

No particular limitation is imposed in the developer composition A upon the amount of one or more constituents selected from the polyvalent metal compound, antioxidant and reducing agent.

The amount of one or more constituents selected from the polyvalent metal compound, antioxidant and reducing agent is usually 0.1 to 5 parts by weight, preferably 0.2 to 3 parts by weight, more preferably 0.3 to 2 parts by weight for 100 pasts by weight of one or more compounds represented by the formula (1).

No particular restriction is imposed upon the species of one or more compounds selected from the polyvalent metal compound, antioxidant and reducing agent. However, polyvalent metal compounds are preferably used because the effect of the invention can be exhibited by relatively small amount of the constituents.

In the developer composition A, the compound represented by the formula (1), polyvalent metal compound, antioxidant and reducing agent can be used singly or as a mixture, respectively.

The developer composition A for use in the heat sensitive recording material comprises, as electron acceptor, one or more compounds represented by the formula (1), and one or more constituents selected from polyvalent metal compound, antioxidant and reducing agent.

No particular restriction is put upon the preparation method of the developer composition A. For example, the composition is prepared by solid state mixing of one or more compounds represented by the formula (1) with one or more constituents selected from polyvalent metal compound, antioxidant and reducing agent so as to obtain a desired ratio. Alternatively, aqueous dispersion of the composition is prepared in the presence of water by atomizing and dispersing one or more compounds represented by the formula (1) together with one or more constituents selected from polyvalent metal compound, antioxidant and reducing agent.

When mixing in the presence of water, known dispersant, for example, polyvinyl alcohol, sodium polyacrylate, sodium polystyrene sulfonate or methyl cellulose can be added in order to enhance dispersibility.

When the dispersant is used, the amount is usually 0.01 part by weight or more, preferably 0.1 to 20 parts by weight for 100 parts by weight of one or more compounds represented by the formula (1).

The amount of the developer composition is usually 10 to 60 parts by weight, preferably 20 to 50 parts by weight for 100 parts by weight of the aqueous dispersion of developer composition.

The temperature for preparing the developer composition A is not restricted in particular, preferably from 10° C. to less than the melting point of one or more compounds represented by the formula (1), polyvalent metal compound, antioxidant and reducing agent. However, the preparation can also be carried out in temperature higher than the melting point of one or more compounds represented by the formula (1), polyvalent metal compound, antioxidant or reducing agent.

Mixing can be preferably carried out with an agitetive mixer, for example, a mortar, propeller stirrer, turbine stirrer, paddle mixer, homogenizer, homomixer, line mixer, line homomixer and other agitative mixers without media; or an attrition mill, centrimill and other stirring tank type mills, sand mill, grain mill, pearl mill, dyno mill and other flow type mills, conical ball mill, annular mill and other annular type, continuous wet stirring mill which are packed with media such as glass beads, ceramic balls or steel balls.

The developer composition A prepared as above sometimes forms salvation products such as hydrate. Such solvation products are also included in the developer composition A and can be used for the electron acceptor compound in the heat sensitive recording material of the invention.

Of course, the developer composition A obtained by removing water or other solvents from the solution products can also used for heat sensitive recording material of the invention.

No particular limitation is imposed upon the amount of the developer composition A used for an electron acceptor constituent in the heat sensitive recording material of the invention.

The amount is generally 50 to 700 parts by weight, preferably 100 to 500 parts by weight for 100 parts by weight of the electron donative, color forming compound.

The term "electron acceptor compound (developer)" is referred to as a compound having a function to develop color of the electron donative, color forming compound at elevated temperature.

The electron donative, color forming compound which can be used for the heat sensitive recording material of the invention is not restricted in particular and includes triarylmethane, vinyl phthalide, diarylmethane, rhodaminelactam, thiazine, fluorene, pyridine, spiro and fluorene base compounds and other various species of known electron donative, color forming compounds, more preferably fluorane base compounds, most preferably the fluorane base compound represented by the formula(A):

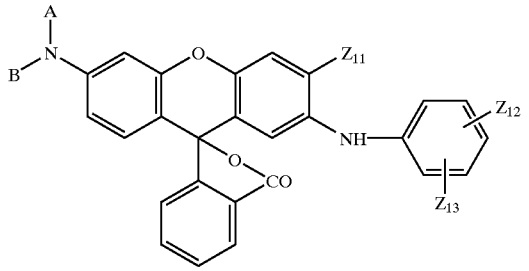

wherein A and B are a C1 to C8 alkyl, C5 to C8 cycloalkyl, C3 to C8 alkoxyalkyl. C6 to C10 aryl or tetrahydrofurfuryl group, A and B can form a heterocyclic ring by bonding with a nitrogen atom, Z11 is a hydrogen or halogen atom or a C1 to C4 alkyl or alkoxy group, and Z12 and Z13 are a hydrogen or halogen atom or a C1 to C4 alkyl group or trifluoromethyl group.

As to the specific examples of the electron donative, color forming compound, exemplary triarylmethane base compounds include, for example, 3,3-bis(4-dimethylaminophenyl)-6-dimethylaminophthalide ["crystal violet lactone"]

3,3-bis(4-dimethylaminophenyl)phthalide, 3-(4-dimethylaminophenyl)-3-(4-diethylamino-2-methylphenyl)-6-dimethylaminophthalide, 3-(4-dimethylaminophenyl)-3-(1,2-dimethylindole-3-yl) phthalide, 3-(4-dimethylaminophenyl)-3-(2-methylindole-3-yl) phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide,
3,3-bis(2-phenylindole-3-yl)-6-dimethylaminophthalide and
3-(4-dimethylaminophenyl)-3-(1-methylpyrrole-3-yl)-6-dimethylaminophthalide.

Useful vinylphthalide base compounds include, for example, 3,3-bis-[1,1-bis(4-dimethylaminophenyl)ethylene-2-yl]-4,5,6,7-tetrachlorophthalide,
3,3-bis-[1,1-bis(4-pyrrolidinophenyl)ethylene-2-yl]-4,5,6,7-tetrabromophthalide,
3,3-bis-[1-(4-dimethylaminophenyl)-1-(4-methoxyphenyl)ethylene-2-yl]-4,5,6,7-tetrachlorophthalide,
3,3-bis-[1-(4-pyrrolidinophenyl)-1-(4-methoxyphenyl)ethylene-2-yl]-4,5,6,7-tetrachlorophthalide
3-[1,1-di(1-ethyl-2-methylindole-3-yl)ethylene-2-yl]-3-(4-diethylaminophenyl)phthalide and 3-[1,1-di(1-ethyl-2-methylindole-3-yl)ethylene-2-yl]-3-(4-N-ethyl-N-phenylaminophenyl)phthalide, Diarylmethane base compounds include, for example, 4,4-bis-dimethylaminobenzhydrinebenzylether, N-halophenyl-leucoauramine and N-2,4,5-trichlorophenylleucoauramine.

Rhodamine-lactam base compounds include, for example, rhodamine-B-anilinolactam, rhodamine-(4-nitroanilino) lactam and rhodamine-B-(4-chloroanilino)lactam.

Thiazine base compounds include, for example, 3,7-bis (diethylamino)-10-benzoylphenoxazine, benzoylleucomethylene blue and 4-nitrobenzoylmethylene blue.

Representative fluorane base compounds include, for example, 3,6-dimethoxyflourane, 3-dimethylamino-7-methoxyfluorane, 3-diethylamino-6-methoxyfluorane, 3-diethylamino-7-methoxyfluorane, 3-diethylamino-7-chlorofluorane, 3-diethylammo-6-methyl-7-chlorofluorane, 3-diethylamino-6,7-dimethylfluorane, 3-N-cyclohexyl-N-n-butylamino-7-methylfluorane, 3-diethylamino-7-dibenzylaminofluorane, 3- diethylamino-7-octylaminofluorane, 3-diethylamino-7-di-n-hexylaminofluorane, 3-diethylamino-7-anilinofluorane, 3-diethylamino-7-(2'-fluorophenylamino)fluorane, 3-diethylamino-7-(2'-fluorophenylamino)fluorane, 3-diethylamino-7-(3'-chlorophenylamino)fluorane, 3-diethylamino-7-(2',3'-dichlorophenylamino)fluorane, 3-diethylamino-7-(3'-trifluoromethylphenylamino)fluorane, 3-di-n-butylamino-7-(2'-fluorophenylamino)fluorane, 3-di-n-butylamino-7-(2'-chlorophenylamino)fluorane, 3-N-n-hexyl-N-ethylamino-7-(2'-chlorophenylamino)fluorane, 3-diethylamino-6-chloro-7-anilinofluorane, 3-di-n-butylamino-6-chloro-7-anilinofluorane, 3-diethylamino-6-methoxy-7-anilinofluorane, 3-di-n-butylamino-6-ethoxy-7-anilinofluorane, 3-pyrrolidino-6-methyl-7-anilinofluorane, 3-piperidino-6-methyl-7-anilinofluorane, 3-morpholino-6-methyl-7-anilinofluorane 3-dimethylammo-6-methyl-7-anilinofluorane, 3-diethylamino-6-methyl-7-anilinofluorane, 3-di-n-butylamino-6-methyl-7-anilinofluorane, 3-di-n-pentylamino-6-methyl-7-anilinofluorane, 3-N-ethyl-N-methylamino-6-methyl-7-anilinofluorane, 3-N-n-propyl-N-methylamino-6-methyl-7-anilinofluorane, 3-N-n-propyl-N-ethylamino-6-methyl-7-anilinofluorane, 3-N-n-butyl-N-methylamino-6-methyl-7-anilinofluorane, 3-N-n-butyl-N-ethylamino-6-methyl-7-anilinofluorane, 3-N-isobutyl-N-methylamino-6-methyl-7-anilinofluorane, 3-N-isobutyl-N-ethylamino-6-methyl-7-anilinofluorane, 3-N-isopentyl-N-ethylamino-6-methyl-7-anilinofluorane, 3-N-n-hexyl-N-methylamino-6-methyl-7-anilinofluorane, 3-N-cyclohexyl-N-ethylamino-6-methyl-7-anilinofluorane, 3-N-cyclohexyl-N-n-propylamino-6-methyl-7-anilinofluorane, 3-N-cyclohexyl-N-n-butylamino-6-methyl-7-anilinofluorane, 3-N-cyclohexyl-N-n-hexylamino-6-methyl-7-anilinofluorane, 3-N-cyclohexyl-N-n-octylamino-6-methyl-7-anilinofluorane, 3-N-(2'-methoxyethyl)-N-methylamino-6-methyl-7-anilinofluorane, 3-N-(2'-methoxyethyl)-N-ethylamino-6-methyl-7-anilinofluorane, 3-N-(2'-methoxyethyl)-N-isobutylammo-6-methyl-7-anilinofluorane, 3-N-(2'-ethoxyethyl)-N-methylamino-6-methyl-7-anilinofluorane, 3-N-(2'-ethoxyethyl)-N-ethylamino-6-methyl-7-anilinofluorane, 3-N-(3'-methoxypropyl)-N-methylamino-6-methyl-7-anilinofluorane, 3-N-(3'-methoxypropyl)-N-ethylamino-6-methyl-7-anilinofluorane, 3-N-(3'-ethoxypropyl)-N-methylamino-6-methyl-7-anilinofluorane, 3-N-(3'-ethoxypropyl)-N-ethylamino-6-methyl-7-anilinofluorane, 3-N-2'-tetrahydrofurfuryl-N-ethylamino-6-methyl-7-anilinofluorane, 3-N-(4'-methylphenyl)-N-ethylamino-6-methyl-7-anilinofluorane, 3-diethylamino-6-ethyl-7-anilinofluorane, 3-diethylamino-6-methyl-7-(3'-methylphenylamino)fluorane, 3-diethylamino-6-methyl-7-(2', 6'-dimethylphenylamino)fluorane, 3-di-n-butylamino-6-methyl-7-(2', 6'-dimethylphenylamino)fluorane, 3-di-n-butylamino-7-(2', 6*-dimethylphenylamino)fluorane, 2,2-bis[4'-(3-N-cyclohexyl-N-methylamino-6-methylfluorane)-7-yl-aminophenyl]propane, 3-[4'-(4-phenylaminophenyl) aminophenyl]amino-6-methyl-7-chlorofluorane, and 3-[4'-(dimethylaminophenyl)]amino-5,7-dimethylfluorane.

Pyridine base compounds include, for example, 3-(2-ethoxy-4-diethylaminophenyl)-3-(1-octyl-2-methylindole-3-yl)-4- or 7-azaphthalide,
3-(2-ethoxy-4-diethylaminophenyl)-3-(1-ethyl-2-methylindole-3-yl)-4- or 7-azaphthalide,
3-(2-hexyloxy-4-diethylaminophenyl)-3-(1-ethyl-2-methylindole-3-yl)-4- or 7-azaphthalide,
3-(2-ethoxy-4-diethylaminophenyl)-3-(1-ethyl-2-phenylindole-3-yl)-4- or 7-azaphthalide, and
3-(2-butoxy-4-diethylaminophenyl)-3-(1-ethyl-2-phenylindole-3-yl)-4- or 7-azaphthalide, Spiro base compounds include, for example, 3-methyl-spiro-dinaphthopyrene, 3-ethyl-spiro-dinaphthopyrene,
3-phenyl-spiro-dinaphthopyrene, 3-benzyl-spiro-dinapthopyrene,
3-methylnaphtho-(3-methoxybenzo)-spiropyrene,
and 3-propyl-spiro-dibenzopyrene.

Fluorene base compounds include, for example, 3,6-bis(dimethylamino)fluorene-9-spiro-3'-(6'-dimethylamino)phthalide and
3,6-bis(diethylamino)fluorene-9-spiro-3'-(6'-dimethylamino)phthalide.

Of course, the electron donative, color forming compound of the invention is not restricted to these exemplified compounds and can be used singly or a mixture.

The heat sensitive recording material of the invention is characterized by comprising the developer composition A of the invention as the electron acceptor compound. Other electron acceptor compounds can also be used simultaneously in the range of not impairing the desired effect of the invention.

In such cases, the proportion of the developer composition A in the overall electron acceptor compounds is usually 20% by weight or more, preferably 50% by weight or more, more preferably 60% by weight or more.

The electron acceptor compounds other than the developer composition A of the invention are not restricted in particular and include phenol derivative or metal salt of the same, organic acid derivative or metal salt of the same, complex, urea derivative and the organic or inorganic electron acceptor compounds and other various species of known electron acceptor compounds.

Specific compounds of the electron acceptor compounds other than the developer composition A of the invention include, for example, 4-tert-butylphenol, 4-tert-octylphenol, 4-phenylphenol, 1-naphthol, 2-naphthol, hydroquinone, resorcinol, 4-tert-octylcatechol, 2,2'-dihydroxybiphenol, 4,4'-dihydroxydiphenol ether, 2,2-bis(4'-hydroxyphenyl) propane ["bisphenol A"], 1,1-bis(4'-hydroxyphenyl) cyclohexane, 2,2-bis(4'-hydroxy-3'-methylphenyl)propane, 1,3-bis(4'-hydroxycumyl)benzene, 1,4-bis(4'-hydroxycumyl)benzene, 1,3,5-tris(4'-hydroxycumyl) benzene, n-butyl bis(4-hydroxyphenyl)acetate, ethyl -2,2-bis(4'-hydroxyphenyl)acetate, n-butyl 4,4-bis(4'-hydroxyphenyl)pentate, benzyl 4-hydroxybenzoate, phenethyl 4-hydroxybenzoate, phenoxyethyl 2,4-dihydroxybenzoate, dimethyl 4-hydroxyphthalate, n-propylgallate, n-octyl gallate, n-dodecyl gallate, n-octadecyl gallate, hydroquinone monobenzyl ether, bis(3-methyl-4-hydroxyphenyl)sulfide, bis(2methyl-4-hydroxyphenyl)sulfide, bis(3-phenyl-4-hydroxyphenyl) sulfide. bis(3-cyclohexyl-4-hydroxyphenyl)sulfide, bis(4-hydroxyphenyl)sulfoxide. bis(4-hydroxyphenyl)sulfone, bis (3-allyl-4-hydroxyphenyl)sulfone, bis(3-phenyl-4-hydroxyphenyl)sulfone, 4-hydroxy-4'-methyldiphenyl sulfone, 4-hydroxy-4'-tert-butyldiphenyl sulfone, 4-hydroxy-4'-chlorodiphenyl sulfone, 4-hydroxy-4'-methoxydiphenyl sulfone, 4-hydroxy-4'-n-propoxydiphenyl sulfone, 4-hydroxy-4'-isopropoxydiphenyl sulfone, 4-hydroxy-4'-n-butoxydiphenyl sulfone, 4-hydroxy-4'-chlorodiphenyl sulfone, 4-hydroxy-4'-benzyloxydiphenyl sulfone, 3,4-dihydroxy-4'-methyldiphenyl sulfone, 2,4'-dihydroxydiphenyl sulfone, 2-methoxy-4'-hydroxydiphenyl sulfone, 2-ethoxy-2'-hydroxydiphenyl sulfone, 4-hydroxy-3-methyl-4'-n-propoxydiphenyl sulfone, bis(2-hydroxy-5-tert-butylphenyl) sulfone, bis(2hydroxy-5-chlorophenyl) sulfone, bis[4-(3'-hydroxyphenyloxy)phenyl]sulfone, 4-hydroxybenzophenone, 2,4-dihydroxybenzophenone, 2,4'-dihydroxybenzophenone, 4,4'-dihydroxybenzophenone, 1,7-di(4'-hydroxyphenylthio)-3,5-dioxaheptane, 1,5di(4'-hydroxyphenylthio)-3-oxapentane, 2,4-dihydroxy-2'-methoxybenzoamlide and other phenol derivatives; metal salts of these phenol derivatives such as nickel, zinc, aluminum and calcium salts;

5-[4'-{2-(4-methoxyphenoxy)ethoxy}cumyl]salicylic acid, 4-[3'-(4-methylphenylsulfone)propoxy]salicylic acid, 4-[2'-(4-methoxylphenoxy)ethoxy]salicylic acid, 4-n-butyloxycarbonylaminosalicylic acid, 4-n-octyloxycarbonylaminosalicylic acid, 4-n-nonyloxycarbonylaminosalicylic acid, 4-n-decyloxycarbonylaminosalicylic acid, 5-cyclohexyloxycarbonylaminosalicylic acid, 1-naphthoic acid, 2-naphthoic acid, 1-hydroxy-2-naphthoic acid, 2hydroxy-3-naphthoic acid, 2-hydroxy-6-naphthoic acid, 1-acetyloxy-2-naphthoic acid, 2-acetyloxy-1-naphthoic acid, 2-acetyloxy-3-naphthoic acid, monobenzyl phthalate, monophenyl phthalate, isophthalic acid, terephthalic acid, 4-methylbenzoic acid, 4-tert-butylbenzoic acid, 2-benzoylbenzoic acid, 2(4'-chloro-benzoyl)benzoic acid, 4-nitrobenzoic acid, 4-chlorobenzoic acid, 4-trifluoromethylbenzoic acid, 4-formylbenzoic acid, 4-cyanobenzoic acid, stearic acid and other organic acid derivatives and metal salts thereof such as nickel, zinc, aluminum or calcium salt; antipyrin-zinc thiocyanate complex, acetylacetone-molybdic acid complex, and other complexes;

N,N-diphenylthiourea, N,N'-di(3-trifluoromethylphenyl) thiourea, N,N-di(3-chlorophenyl)thiourea, 1,4-di(3'-chlorophenyl)-3-thiosemicarbozide, N-phenyl-N'-(4-methylphenylsulfone)urea, 4,4'-bis(4"-methylphenylsulfonaminocarbonylamino)diphenylmethane, and other urea derivatives;

and inorganic electron acceptor compounds such as clay, attapulgite, activated clay, aluminum chloride, zinc chloride and zinc bromide. The electron acceptor compounds are not limited to these compounds and can also be used as a mixture.

A heat fusible compound having a melting point of 70 to 150° C., preferably 80 to 130° C. can be favorably added as a sensitizer into the heat sensitive recording layer in order to obtain a heat sensitive recording material which is suited for high speed recording.

The amount of added heat fusible compounds is not limited in particular and is generally 10 to 700 parts by weight, preferably 20 to 500 parts by weight for 100 parts by weight of the electron donative, color forming compound.

Specific examples of the heat fusible compounds are, for example, capronamide, caprinamide, palmitamide, stearamide, oleamide, erucamide, linolamide, linolenamide, N-ethylcaprinamide, N-butyllauramide, N-methylstearamide, N-methyloleamide, N-stearylcyclohexylamide, N-octadecylacetamide, N-oleylacetamide, stearylurea, stearanilide, linolanilide, N-ethylcarbazole, 4-methoxydiphenylamine, N-hydroxymethylstearamide, methylenebis stearamide, ethylenebisstearamide, acetanilide, 2-benzoylacetanilide, acetoacetanilide, 2'-methylacetoacetanilide, 4'-methylacetoacetanilide, 2',4-dimethylacetoacetanilide, 2'-methoxyacetoacetanilide, 4'-methyoxyacetoacetanilide, 2'-chloroacetoacetanilide, 4'-chloroacetoacetanilide, 4'-chloro-2',5'-dimethoxyacetoacetamlide and other nitrogen containing compounds;

benzyl 4-benzyloxybenzoate, phenyl 2-naphthoate, phenyl 1-hydroxy-2naphthoate, dibenzyl oxalate, di(4-methylbenzyl) oxalate, di(4-chlorobenzyl) oxalate, diphenyl adipate, diphenacyl glutarate, di(4-methylphenyl) carbonate, dimethyl terephthalate, dibenzyl terephthalate, methyl 4-benzoyloxybenzoate, and other ester compounds;

4-benzylbiphenyl, m-terphenyl, 1,2-bis(3',4'-dimethylphenyl)ethane, fluorene, fluorenthene, 2,6-diisopropylnaphthalene, 3-benzylacenapthene and other hydrocarbon compounds;

2-benzyloxynaphthalene, 2-(4'-methylbenzyloxy) naphthalene, 1,4-diethoxynaphthalene, 1,2-diphenoxyethane, 1,2-bis(3'-methylphenoxy)ethane, 1-phenoxy-2-(4'-methylphenoxy)ethane, 1-phenoxy-2-(4'-ethylphenoxy)ethane, 1-(4'-methoxyphenoxy)-2-phenoxyethane, 1-(4'-methoxyphenoxy)-2-(3'-methylphenoxy)ethane, 1-(4'-methoxyphenoxy)-2-(2'-methylphenoxy)ethane, 1,2-bis(4'-methoxyphenylthio) ethane, 1,5-bis(4'-methoxyphenoxy)-3-oxapentane, 1,4-bis (2'-vinyloxymethoxy)benzene, 4-(4'-methylphenoxy) biphenyl, 1,4-dibenzyloxybenzene, 1,4-bis(2'-chlorobenzyloxy)benzene, 4,4'-di-n-butoxydiphenylsulfone, 4,4'-diallyloxydiphenyl sulfone, 1,2-bis(phenoxymethyl) benzene, 1,2-diphenoxybenzene, 1,4-bis(2'-chlorophenoxy) benzene, 1,4-bis(4'-methylphenyloxy)benzene, 1,4-bis(3'-methylphenoxymethyl)benzene, 4-chlorobenzyloxy-(4'-ethoxybenzene), 4,4'-bis(phenoxy)diphenyl ether, 4,4'-bis (phenoxy)diphenyl thioether, 1,4-bis(4'-benzylphenoxy) benzene, 1,4-bis[(4'-methylphenyloxy)methoxymethyl] benzene and other ether compounds;

and 1,4-diglycidyloxybenzene, 4-benzyloxy-4'-(2methylglycidyloxy)diphenyl sulfone, 4-(4-methybenzyloxy)-4'-glycidyloxydiphenyl sulfone, N-glycidyl phthalimide and other epoxy compounds.

However, heat fusible compounds are not restricted to these exemplified compounds and can be used singly or as a mixture.

Preparation of the heat sensitive recording material of the invention requires no special technique and can be carried out by known methods. Generally, the coating liquid for use in the heat sensitive recording layer can be prepared in the presence of water by milling, dispersing and mixing the electron donative, color forming compound, the developer composition A of the invention and, when desired, the heat fusible compound, all together or separately to a particle size of usually 3 μm or less, preferably 2 μm or less with a ball mill, vertical or horizontal sand mill, attrition mill, colloid mill and other milling and mixing equipment.

The coating liquid for use in the heat sensitive recording layer usually comprises binder and pigment.

The amount of binder is not limited in particular and generally 5 to 50% by weight for the total solid content.

Generally, water soluble binders and water insoluble binders are used, water soluble binders are preferred.

Water soluble binders include, for example, polyvinyl alcohol, carboxy modified polyvinyl alcohol, sulfonated polyvinyl alcohol, alkylated polyvinyl alcohol and other polyvinyl alcohol derivatives; methylcellulose, carboxy methylcellulose, hydroxyethylcellulose, hydroxypropylcellulose, and other cellulose derivatives; epichlorohydrin modified polyamide, ethylene-maleic anhydride copolymer, styrene-maleic anhydride copolymer, isobutylene-maleic anhydride copolymer, polyacrylic acid, polyacrylamide, methylol modified polyacrylamide, starch, starch derivatives such as oxidized starch and etherated starch; and casein, gelatin and gum arabic.

As to the water insoluble binders, synthetic rubber latex and synthetic resin emulsion are generally known and include, for example, styrene-butadiene rubber latex, acrylonitrile-butadiene latex, methyl acrylate-butadiene rubber latex and vinyl acetate emulsion.

These binders can be used singly or as a mixture. Water soluble binders and water insoluble binders can, of course, be used in combination.

The amount of pigment is not limited in particular, and is used generally 50 to 70 parts by weight, preferably 100 to 500 parts by weight for 100 parts by weight of the electron donative, color forming compound.

Pigment which can be used in the invention include, for example, calcium carbonate, amorphous silica, amorphous calcium silicate, barium carbonate, magnesium carbonate, zinc carbonate, zinc oxide, aluminum oxide, titanium oxide, aluminum hydroxide, magnesium hydroxide, barium sulfate, talc, agalmatolite, kaolin, clay, diatomaceous earth, silica and other inorganic pigments; and styrene micro ball, nylon particle, urea-formaldehyde filler, polyethylene particle, cellulose filler, starch particle, silicone resin particle and other organic pigments. However, pigments are not restricted to these exemplified compounds and can be used singly or as a mixture.

In view of various properties of the heat sensitive recording material, for example, suitability for a thermal head, preferred pigment has an oil absorption amount of 50 ml/100 g or more in accordance with JIS K-5101. Inorganic pigments having the same range of oil absorption are more preferably used. Calcium carbonate, amorphous silica and amorphous calcium silicate which have the same oil absorption range as above are most preferably used.

Further, a metal soap, wax, surface active agent, ultraviolet absorber (ultraviolet stabilizer), crosslinking agent, hindered phenol compound, phosphorus base compound and antifoaming agent can be added, when required, to the coating liquid for use in the heat sensitive recording layer.

For example, addition of an ultraviolet absorber (ultraviolet stabilizer) or hindered phenol compound to the heat sensitive recording layer can favorably improve properties of the heat sensitive recording material, for example, preservation stability of a developed image.

Metal soaps include, for example, zinc stearate, calcium stearate, aluminum stearate, zinc oleate and other metal salts of higher fatty acid.

Wax include, for example, paraffin wax, midrocrystalline wax, carboxymodified paraffin wax, carnauba wax, polyethylene wax, polystyrene wax, candellila wax, montan wax and higher fatty acid esters.

Surface active agents (dispersants) include, for example, sulfosuccinic acid base alkali metal salts such as sodium di(n-hexyl)sulfosuccinate, and sodium di(2-ethylhexyl) sulfosuccinate, sodium dodecylbenzenesulfonate, sodium salt of lauryl alcohol sulfate ester, metal salts of fatty acid and fluorine containing surface active agents.

Ultraviolet absorbers (ultraviolet stabilizers) are compounds which can absorb at least a portion of ultra violet radiation having a wave length of about 300 to about 400 mm.

Ultraviolet absorbers include, for example, cinnamic acid derivatives, benzophenone derivatives, triazole derivatives, salicylic acid derivatives, cyanoacrylate derivatives and hindered amine derivatives. Triazole derivatives are particularly preferred for ultraviolet absorbers.

Triazole derivatives include, for example, 2-(2'-hydroxy-5'-methylphenyl)benzotriazole, 2-(2'-hydroxy-5'-tert-butylphenyl)benzotriazole, 2-(2'-hydroxy-3',5'-di-tert-butylphenyl)benzotriazole, 2-(2'-hydroxy-3'-tert-butyl-5'-methylphenyl)-5-chlorobenzotriazole, 2-(2'-hydroxy-3',5'-di-tert-butylphenyl)-5-chlorobenzotriazole, 2-(2'-hydroxy-3',5'-di-tert-amylphenyl)benzotriazole and 2-(2'-hydroxy -5'-tert-octylphenyl)benzotriazole. However, triazole derivatives are not restricted to these exemplified compounds and can be used singly or as a mixture.

No particular limitation is imposed upon the amount of the ultraviolet absorber. The amount is generally 10 to 400 parts by weight, preferably 20 to 300 parts by weight for 100 parts by weight of the electron donative, color forming compound.

Crosslinking agents include, for example, glyoxal and other aldehyde derivatives, epoxy compounds, polyamides resins, diglycidyl compounds, aziridine compounds, magnesium chloride and ferric chloride.

Hindered phenol compounds are preferably phenol derivatives which have an branched alkyl group on one or both ortho-positions to a phenolic hydroxyl group.

Representative hindered phenol compounds include, for example, 2,6-diisopropyl-4-methylphenol, 2,6-di-tert-butyl-4-methylphenol, 2-tert-butyl-4-methoxyphenol, 2,5-di-tert-octyl-4-methoxyphenol, 2,5-di-tert-butylhydroquinone, 2,5-di-tert-octylhydroquinone, 1,1,3-tris(2'-methyl-4'-hydroxy-5'-tert-butylphenyl)butane, 1,1,3-tris(2'-methyl-4-hydroxy-5'-cyclohexylphenyl)butane, 1,1,3-tris(2'-ethyl-4'-hydroxy)-5'-tertbutylphenyl)butane, 1,1,3-tris(3',5'-di-tert-butyl-4'-hydroxyphenyl)butane, 1,1,3-tris(2'-methyl-4'-hydroxy-5'-tert-butylphenyl)propane, 1,1-bis(2'-methyl-5'-tert-butyl-4'-hydroxyphenyl)butane, tetrakis[methylene-3-(3',5'-di-tert-butyl-4'-hydroxyphenyl)propionate]methane, bis(3-tert-butyl-5-methyl-2-hydroxyphenyl)methane, bis(3-tert-butyl-5-ethyl-2-hydroxyphenyl)methane, 1,3,5-trimethyl-2,4,6-tris(3',5'-di-tert-butyl-4'-hydroxybenzyl)benzene, 1,3,5-tris (4'-tert-butyl-3'-hydroxy-2',6'-dimethylbenzyl)isocyanuric acid, 1,3,5-tris(4'-tert-butyl-3'-hydroxy-2'-methyl-6'-ethylbenzyl)isocyanuric acid and bis(2-methyl-4-hydroxy-5-tert-butylphenyl)sulfide. However, hindered phenol compounds are not restricted to these exemplified compounds, and can be used singly or as a mixture.

The amount of the hindered phenol compound is not limited in particular and generally 10 to 400 parts by weight, preferably 20 to 300 parts by weight for 100 parts by weight of the electron donative, color forming compounds.

Preferred phosphorus base compounds are phosphite and include, for example,
2,2'-methylenebis(4"-methyl-6"-tert-butylphenyl)phosphite, 2,2'-methylenebis(4"-ethyl-6"-tert-butylphenyl)phosphite, 2,2'-methylenebis(4",6"-di-tert-butylphenyl)phosphite, diphenylphosphite, bis(4-tert-butylphenyl)phosphite, bis(2,4-di-tert-butylphenyl)phosphite, bis(4-chlorophenyl)phosphite, bis(2-phenylphenyl)phosphite, bis(4-phenylphenyl)phosphite and metal salts of these compounds, for example, potassium, sodium, zinc, calcium, magnesium and aluminum salts.

On the heat sensitive recording material of the invention, no particular restriction is imposed upon the forming method of the heat sensitive recording layer. Conventionally known method can be applied, for example, the coating liquid for use in the heat sensitive recording layer can be coated on a carrier with an air knife coater, blade coater, bar coater, short dwell coater, gravure coater, curtain coater, roll coater, wire coater or other suitable coating apparatuses, and dried to form a heat sensitive recording layer.

The coating amount of heat-sensitive recording layer is not restricted in particular, and is generally 1.5 to 12 g/m$^2$, preferably 2 to 10 g/m$^2$ on dry weight.

No particular restriction is imposed upon the carrier.

Carrier which can be used includes, for example, paper such as wood free paper, art paper, coated paper, oil-resistant paper and regenerated paper; plastics such as polyethylene, polypropylene, polyester, polystyrene and nylon; sheet, synthetic paper, plastic-laminated paper, composite sheet obtained by combination of these materials; non-woven fabric sheet, molded items and metalized materials.

The heat sensitive recording material of the invention also includes a type which has one or more undercoat layers between the carrier and the heat sensitive recording layer.

Installation of the undercoat layer can further increase color development sensitivity and enhance dot reproducibility on printing.

Generally, the undercoat layer comprises pigments or synthetic resins.

The pigments which can be used for the undercoat layer include, for example, calcined kaolin, aluminum hydroxide, calcium carbonate, barium sulfate, zinc oxide, lithopone, agalmatolite, kaolin, silica and amorphous silica. Calcined kaolin is more preferably used.

The synthetic resins which can be used for the undercoat layer include, for example, styrene-acrylic resin, polystyrene resin, polyethylene resin, polypropylene resin and polyacetal resin. These synthetic resins are preferably used in the form of spherical particles or spherical, hollow particles, more preferably spherical plastic or spherical, hollow plastic particles having an average particle size of 0.5 to 3 $\mu$m, most preferably spherical plastic particles or spherical, hollow particles of styrene-acrylic resin having an average particle size of 0.5 to 3 $\mu$m.

Pigment and synthetic resins can be used singly or as a mixture.

Generally, the coating liquid used for an undercoat layer is prepared in the form of aqueous dispersion by mixing with a binder in addition to pigments or synthetic resins.

The binder which can be used in the same as used for forming the recording layer.

Further, when desired, the coating liquid used for the undercoat layer can be incorporated with a demolding agent, waterproof agent, sizing agent such as alkenylsuccinate, alkenylketone dimer and rosin compound, and wax such as paraffin wax, micro-crystalline wax, carboxy-modified paraffin wax, carnauba wax, polyethylene wax, polystyrene wax, candellila wax, montan wax and higher fatty acid ester.

The coating liquid used for the undercoat layer can be coated on a carrier with an air knife coater, blade coater, bar coater, short dwell coater, gravure coater, curtain coater, roll coater, wire bar or other suitable coating apparatus and dried to form an undercoat layer.

The coating amount of the undercoat layer is not limited in particular and is generally 0.5 to 20g/m$^2$ on dry weight, preferably 1 to 15 g/m$^2$. When the principal component of the undercoat layer is synthetic resin, suitable film, thickness, for example, 2 to 50 $\mu$m can also be prepared.

EXAMPLES

The present invention will hereinafter be illustrated further in detail by way of preparation examples and examples. However, the scope of the invention is not limited by these preparation examples and examples. Unless otherwise noted, % means % by weight.

Preparation Example 1

Preparation of Developer Composition

In 200 ml of dichloroethane, 22 g of 4-aminophenol, 38 g of 4-methylbenzenesulfonylchloride and 16 g of pyridine were stirred for 4 hours at room temperature. After washing the reaction mixture with water, dichloromethane solution was separated and dichloromethane was distilled off under reduced pressure. The residue was recrystallized from butyl acetate to obtain 42 g of colorless crystal. The crystal was analyzed by high performance liquid chromatography.

The result identified as almost pure N-(4-hydroxyphenyl)-(4'-methylbenzene)sulfonamide (compound of exemplified No 1-25).

To the above crystal, 0.2 g of zinc sulfate 7 hydrate was added and mixed in a mortar until a uniform dispersion was formed. Thus crystal composition was obtained.

The composition was used as a developer composition for the electron acceptor compound of the heat sensitive recording material.

Example 1

3-Di-n-butylamino-6-methyl-7-anilinofluorane was used as an electron donative color forming compound. 2-Benzoyloxynaphthalene was used as a heat fusible compound. The developer composition prepared in Preparation Example 1 was used as an electron acceptor compound. A heat sensitive recording material was prepared as follows.

[Preparation of heat sensitive recording material]

(Liquid-A composition)

| | |
|---|---|
| Electron donative, color forming compound | 10 g |
| Heat fusible compound | 20 g |
| 5% Aqueous methylcellulose solution | 10 g |

-continued

| [Preparation of heat sensitive recording material] | |
|---|---|
| Water | 80 g |
| Total | 120 g |
| (Liquid-B composition) | |
| Electron acceptor compound | 40 g |
| 5% Aqueous methylcellulose solution | 20 g |
| Water | 200 g |
| Total | 260 g |

Dispersions were prepared by milling individually liquid-A and liquid-B above with a sand mill so as to obtain an average particle size of 1.5 $\mu$m.

The developer composition prepared in Preparation Example 1 was dispersed in liquid-B, and 130 g of liquid B was collected, allowed to stand at 20° C. in the air environment, and coloring state of the liquid-B was visually observed after 24 hours.

Next, 120 g of liquid-A, 130 g of liquid-B, 10 g of 30% paraffin wax, 170 g of 10% aqueous polyvinyl alcohol solution (Trade Mark: PVA-105, manufactured by Kuraray) and 25 g of calcium carbonate having oil absorption of 138 ml/100 g (Trade Mark:Calrite K T, manufactured by Shiraishi Corp.) were mixed and dispersed to prepare coating liquid for a recording layer. The coating liquid obtained was coated on a wood free paper having a basis weight of 50 g/m$^2$ so as to obtain a dry weight of 5.5 g/m$^2$, and dried to prepare a heat sensitive recording material.

Examples 2 to 13

A coating liquid for a recording layer and a heat sensitive recording material were prepared by carrying out the same procedures as described in Example 1 except that each compound shown in Table 1 was respectively used for the electron donative, color forming compound and heat fusible compound in liquid-A.

In Table 1, heat fusible compound a is 2-benzyloxynaphthalene,
ibid. b is 1,2-bis(3'-methylphenoxy)ethane,
ibid. c is 4-(4'-methylphenoxy)biphenyl,
ibid. d is di(4-methylbenzyl)oxalate,
ibid. e is diphenyl adipate,
ibid. f is N-hydroxymethylstearamide,
ibid. g is 2'-methylacetanilide,
ibid. h is 4-benzylbiphenyl,
ibid. i is 1,4-dibenzyloxybenzene,
ibid. j is 4,4'-diallyloxydiphenyl sulfone,
ibid. k is dimethyl terephthalate, and
ibid. l is 1,2-bis(3',4'-dimethylphenyl)ethane, respectively.

TABLE 1

| Example | Electron donative, color forming compound | Heat fusible compound |
|---|---|---|
| 2 | 3-di-n-pentylamino-6-methyl-7-anilinofluorane | a |
| 3 | 3-di-n-butylamino-6-methyl-7-anilinofluorane | b |
| 4 | 3-dimethylamino-6-methyl-7-anilinofluorane | c |
| 5 | 3-N-isopentyl-N-ethylamino-6-methyl-7-anilinofluorane | d |
| 6 | 3-N-n-propyl-N-methylamino-6-methyl-7-anilinofluorane | e |

TABLE 1-continued

| Example | Electron donative, color forming compound | Heat fusible compound |
|---|---|---|
| 7 | 3-diethylamino-6-methyl-7-(3'-methylphenylamino)fluorane | f |
| 8 | 3-N-(2'-methoxyethyl)-N-isobutylamino-6-methyl-7-anilino)fluorane | g |
| 9 | 3-N-(3'-ethoxypropyl-N-ethylamino-6-methyl-7-anilino)fluorane | h |
| 10 | 3-diethylamino-7-(2'-fluorophenylamino)fluorane | i |
| 11 | 3-diethylamino-7-(2'-chlorophenylamino)fluorane | j |
| 12 | 3-di-n-butylamino-7-(2'-chlorophenylamino)fluorane | k |
| 13 | 3-diethylamino-7-(3'-trifluorophenylamino)fluorane | l |

Examples 14 to 31

A coating liquid used for a recording layer was prepared by carrying out the procedures as described in Example 1, except that a developer composition shown in Table 2 was used as an electron acceptor compound in liquid-B in place of the developer composition prepared in Preparation Example 1.

Heat sensitive recording material was prepared by using the coating liquid thus obtained. The unit % in the table illustrates % by weight in the composition.

TABLE 2

| Example | Electron acceptor compound | (Developer composition) |
|---|---|---|
| 14 | No.1 - 25 exemplified compound | (99.0%) |
| | Zinc sulfate | (1.0%) |
| 15 | No.1 - 25 exemplified compound | (99.5%) |
| | Zinc sulfate | (0.5%) |
| 16 | No.1 - 25 exemplified compound | (99.0%) |
| | Sodium sulfate | (1.0%) |
| 17 | No.1 - 22 exemplified compound | (97.0%) |
| | 2,6-diisopropyl-4-methylphenol | (3.0%) |
| 18 | No.1 - 22 exemplified compound | (98.8%) |
| | Zinc chloride | (1.2%) |
| 19 | No.1 - 15 exemplified compound | (98.0%) |
| | Sodium thiosulfate | (2.0%) |
| 20 | No.1 - 15 exemplified compound | (99.0%) |
| | bis(4-tert-butylphenyl)phosphate | (1.0%) |
| 21 | No.1 - 16 exemplified compound | (99.4%) |
| | 2,5-di-tert-butylhydroquinone | (0.6%) |
| 22 | No.1 - 65 exemplified compound | (99.1%) |
| | Magnesium sulfate | (0.9%) |
| 23 | No.1 - 109 exemplified compound | (99.4%) |
| | Sodium hydrogen sulfite | (0.6%) |
| 24 | No.1 - 110 exemplified compound | (99.7%) |
| | Zinc sulfate | (0.3%) |
| 25 | No.1 - 25 exemplified compound | (50.0%) |
| | No.1 - 110 exemplified compound | (49.2%) |
| | Zinc sulfate | (0.8%) |
| 26 | No.1 - 22 exemplified compound | (49.0%) |
| | No.1 - 110 exemplified compound | (49.0%) |
| | Zinc sulfate | (2.0%) |
| 27 | No.1 - 24 exemplified compound | (49.0%) |
| | No.1 - 109 exemplified compound | (48.5%) |
| | Zinc sulfate | (2.5%) |
| 28 | No.1 - 25 exemplified compound | (99.5%) |
| | Zinc sulfate | (0.2%) |
| | Magnesium sulfate | (0.3%) |
| 29 | No.1 - 68 exemplified compound | (98.5%) |
| | Zinc sulfate | (0.5%) |
| | 2-tert-butyl-4-methoxyphenol | (1.0%) |
| 30 | No.1 - 98 exemplified compound | (98.1%) |
| | Zinc acetate | (0.6%) |
| | sodium sulfite | (0.3%) |
| | 2,6-di-tert-butyl-4-methylphenol | (1.0%) |

TABLE 2-continued

| Example | Electron acceptor compound | (Developer composition) |
|---|---|---|
| 31 | No.1 - 110 exemplified compound | (99.0%) |
| | bis(4-tert-butylphenyl)phosphite | (0.8%) |
| | Calcium chloride | (0.2%) |

Example 32

A coating liquid for a recording layer was prepared and applied to a heat sensitive recording material by carrying out the same procedures as described in Example 1 except that 25 g of calcium carbonate having an oil absorption amount of 60 ml/100 g (Trade Mark: Carlit 3A, manufactured by Shiraishi Corp.) was used in place of Carlite KT having an oil absorption amount of 138 ml/100 g.

Example 33

A coating liquid for a recording layer was prepared and applied to a heat sensitive recording material by carrying out the same procedures as described in Example 1 except that 25 g of amorphous silica (Trade Mark: P 553A, manufactured by Mizusawa Chemicals) having an oil absorption amount of 70 ml/100 g was used in place of 25 g of calcium carbonate having an oil absorption amount of 138 ml/100 g.

Example 34

A coating liquid for a recording layer was prepared and applied to a heat sensitive recording material by carrying out the same procedures as described in Example 1 except that 40 g of amorphous silica (Trade Mark: P527, manufactured by Mizusawa Chemicals) having an oil absorption amount of 170 ml/100 g was used in place of 25 g of calcium carbonate having an oil absorption amount of 138 ml/100 g.

Example 35

A coating liquid for a recording layer was prepared and applied to a heat sensitive recording material by carrying out the same procedures as described in Example 1 except that 20 g of amorphous calcium silicate(Trade Mark: P832, manufactured by Mizusawa Chemicals) having an oil absorption amount of 145 ml/100 g was used in place of 25 g of calcium carbonate having an oil absorption amount of 138 ml/100 g.

Example 36

A heat sensitive recording material was prepared by carrying out the same procedures as described in Example 1 except that paper equipped with an undercoat layer prepared by the following process was used in place of the wood free paper having a basis of 50 g/m$^2$.

Preparation of Paper Equipped with an Undercoat Layer

A mixture of 80 g of calcined kaolin(Trade Mark: Ansilex 90, manufactured by Engelhardt Co.) and 160 g of a 0.5% aqueous solution of sodium hexamethaphosphate was dispersed with a homogenizer.

To the dispersion obtained, 100 g of a 10% aqueous solution of polyvinyl alcohol (Trade Mark:PVA-105, manufactured by Kuraray Co.) was added and throughly stirred to prepare a coating liquid for use in the undercoat layer.

The coating liquid obtained was applied to wood free paper having a basis weight of 50 g/m$^2$ so as to obtain a dry coating weight of 7.0 g/m$^2$, dried and subjected to supercalender treatment to prepare paper having an undercoat layer.

Example 37

A heat sensitive recording material was prepared by carrying out the same procedures as described in Example 1 except that paper equipped with undercoat layer which was prepared by the following process was used in place of the wood free paper having a basis weight of 50 g/m$^2$.

Preparation of Paper Equipped with an Undercoat Layer

To 400 g of an aqueous dispersion of spherical hollow particles consisting of 25% styrene-acrylic resin which had an average particle size of 1.0 $\mu$m and a viod ratio of 51% by volume, 40 g of styrene-butadiene rubber latex and 10 g of water were added and thoroughly stirred to prepare a coating liquid for use in an undercoat layer.

The coating liquid obtained was applied to wood free paper having a basis weight of 50 g/m$^2$ so as to obtain a coated film thickness of 20 $\mu$m, dried and subjected to supercalender treatment to prepare paper having an undercoat layer.

Example 38

In example 1, 40 g of the developer composition prepared in Preparation Example 1 as the electron acceptor compound in liquid B was replaced by 32 g of the developer composition prepared in Preparation Example 1 and 8 g of 1,1,3-tris(3'-methyl-4'-hydroxy-5'-tert-butyloxyphenyl)butane as hindered phenol. Other procedures were the same as carried out in Example 1 to prepare a coating liquid for use in a recording layer and successively to obtain a heat sensitive recording material.

Example 39

In Example 1, 40 g of the developer composition prepared in Preparation Example 1 as the electron acceptor compound in liquid B was replaced by 32 g of the developer composition prepared in Preparation Example 1 and 8 g of 2-(2'-hydroxy-5'-methylphenyl)benzotriazole as an ultraviolet absorber. Other procedures were the same as carried out in Example 1 to prepare a coating liquid for use in a recording layer and successively to obtain a heat sensitive recording material.

Example 40

In Example 1, 40 g of the developer composition prepared in Preparation Example 1 as the electron acceptor compound in liquid B was replaced by 32 g of the developer composition prepared in Preparation Example land 8 g of 1,4-bis(4'-hydroxycumyl)benzene. Other procedures were the same as carried out in Example 1 to prepare a coating liquid for use in a recording layer and successively to obtain a heat sensitive recording material.

Example 41

In Example 1, 40 g of the developer composition prepared in Preparation Example 1 as the electron acceptor compound in liquid B was replaced by 24 g of the developer composition prepared in Preparation Example 1 and 16 g of 2,4'-dihydroxydiphenyl sulfone. Other procedures were the same as carried out in Example 1 to prepare a coating liquid for use in a recording layer and successively to obtain a heat recording material.

Example 42

In Example 1, 40 g of the developer composition prepared in Preparation Example 1 as the electron acceptor compound in liquid B was replaced 34 g of the developer composition prepared in Preparation Example 1 and 6 g of 4-hydroxy-4'-isopropoxydiphenyl sulfone. Other procedures were the same as carried out in Example 1 to prepare a coating liquid for use in a recording layer and successively to obtain a heat sensitive recording material.

Comparative Example 1

In Example 1, the developer composition prepared in Preparation Example 1 as the electron acceptor compound in liquid B was replaced by N-(4-hydroxyphenyl)-(4'-methybenzene)sulfonamide. Other procedures were the same as carried out in Example 1 to prepare a coating liquid for use in a recording layer and successively to obtain a heat sensitive recording material.

Comparative Example 2

In Example 1, the developer composition prepared in Preparation Example 1 as the electron acceptor compound in liquid B was replaced by N-(4-hydroxyphenyl) butanesulfonamide. Other procedures were the same as carried out in Example 1 to prepare a coating liquid for use in a according layer and successively to obtain a heat sensitive recording material.

Comparative Example 3

In Example 1, the developer composition prepared in Preparation Example 1 as the electron acceptor compound in liquid B was replaced by bisphenol A. Other procedures were the same as carried out in Example 1 to prepare a coating liquid for use in a recording layer and successively to obtain a heat sensitive recording material.

The liquid B dispersions prepared in examples and comparative examples above were allowed to stand for 24 hours and then coloring degree was visually observed. Results are divided into the following two classes, and shown in table 3.

○ Quite no coloring is observed.

X Coloring, even though faint, is observed.

Each heat sensitive recording material was subjected to supercalendar treatment so as to obtain a Beck smoothness of 400 to 500 sec. and successively evaluated by the following method. Results are in Table 3.

Evaluation Method of Heat Sensitive Recording Material

Color Development Sensitive Test

Color development was performed on each heat sensitive recording material with energy of 0.49 mj/dot. The concentration of developed image obtained was measured with a Macbeth densitometer (Model: TR-54). A layer value illustrates better developing sensitivity.

Whiteness Degree Measurement on Undeveloped Portion

Whiteness degree of undeveloped portion on the surface was measured immediately after application of each heat sensitive recording material with a color-difference meter (Trade Mark: Σ-80, manufactured by Nippon Densyoku Co.) A larger value illustrates higher whiteness degree and better preservation stability.

TABLE 3

| Heat sensitive recording material | Coloring degree | Color development sensitivity c | Whiteness degree |
|---|---|---|---|
| Example 1 | ○ | 1.34 | 84.0 |
| Example 2 | ○ | 1.35 | 83.5 |
| Example 3 | ○ | 1.32 | 84.1 |
| Example 4 | ○ | 1.35 | 83.6 |
| Example 5 | ○ | 1.33 | 84.2 |
| Example 6 | ○ | 1.31 | 84.0 |
| Example 7 | ○ | 1.35 | 85.0 |
| Example 8 | ○ | 1.33 | 84.5 |
| Example 9 | ○ | 1.35 | 83.3 |
| Example 10 | ○ | 1.30 | 83.5 |
| Example 11 | ○ | 1.34 | 84.4 |
| Example 12 | ○ | 1.33 | 84.2 |
| Example 13 | ○ | 1.32 | 83.3 |
| Example 14 | ○ | 1.34 | 83.6 |
| Example 15 | ○ | 1.33 | 84.7 |
| Example 16 | ○ | 1.34 | 83.9 |
| Example 17 | ○ | 1.35 | 84.2 |
| Example 18 | ○ | 1.33 | 83.8 |
| Example 19 | ○ | 1.35 | 84.6 |
| Example 20 | ○ | 1.36 | 84.7 |
| Example 21 | ○ | 1.31 | 84.5 |
| Example 22 | ○ | 1.33 | 84.0 |
| Example 23 | ○ | 1.35 | 83.3 |
| Example 24 | ○ | 1.35 | 84.7 |
| Example 25 | ○ | 1.34 | 84.2 |
| Example 26 | ○ | 1.36 | 84.0 |
| Example 27 | ○ | 1.35 | 83.6 |
| Example 28 | ○ | 1.32 | 84.2 |
| Example 29 | ○ | 1.35 | 83.5 |
| Example 30 | ○ | 1.33 | 84.5 |
| Example 31 | ○ | 1.30 | 84.0 |
| Example 32 | ○ | 1.35 | 85.0 |
| Example 33 | ○ | 1.33 | 84.5 |
| Example 34 | ○ | 1.35 | 83.3 |
| Example 35 | ○ | 1.31 | 84.2 |
| Example 36 | ○ | 1.38 | 84.4 |
| Example 37 | ○ | 1.38 | 84.2 |
| Example 38 | ○ | 1.33 | 84.0 |
| Example 39 | ○ | 1.35 | 83.3 |
| Example 40 | ○ | 1.30 | 84.7 |
| Example 41 | ○ | 1.34 | 84.2 |
| Example 42 | ○ | 1.34 | 84.2 |
| Comparative Example 1 | x | 1.31 | 80.8 |
| Comparative Example 2 | x | 1.32 | 79.6 |
| Comparative Example 3 | ○ | 1.19 | 82.0 |

As clearly seen in Table 3, the dispersion prepared by using the developer composition of the invention for an electron acceptor compound causes no coloring and is excellent in stability.

Further, the heat sensitive recording material prepared by using the developer composition of the invention has excellent color development sensitivity and whiteness degree of the undeveloped portion as compared with a heat sensitive recording material prepared from a conventional electron acceptor compound.

What is claimed is:

1. A developer composition comprising one or more compounds represented by the formula (1)

(1)

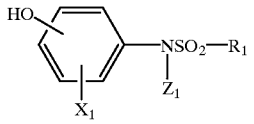

wherein $X_1$ is a hydrogen or halogen atom, an alkyl, alkoxy or hydroxyl group, $Z_1$ is a hydrogen atom or alkyl group, and $R_1$ is an unsubstituted or substituted alkyl or aryl group, and one or more constituents selected from a polyvalent metal compound, antioxidant and reducing agent.

2. A developer composition according to claim 1 wherein the composition comprises 0.1 to 5 parts by weight of one or more constituents selected from a polyvalent metal compound, antioxidant and reducing agent for 100 parts by weight of one or more compounds represented by the formula (1).

3. A developer composition according to claim 1 wherein the polyvalent metal compound is zinc sulfate.

4. A heat sensitive recording material equipped on a carrier with a heat sensitive recording layer comprising an electron donative, color forming compound and an electron acceptor compound wherein said electron acceptor compound is a developer composition according to claim 1.

5. A heat sensitive recording material according to claim 4 wherein the heat sensitive recording layer comprises additionally a heat fusible compound.

6. A heat sensitive recording material according to claim 4 wherein the heat sensitive recording layer comprises additionally an ultraviolet absorber.

7. A heat sensitive recording material according to claim 4 wherein the heat sensitive recording layer comprises additionally a hindered phenol compound.

8. A heat sensitive recording material according to claim 4 wherein the heat sensitive recording layer comprises additionally a binder.

9. A heat sensitive recording material according to claim 4 wherein the heat sensitive recording layer comprises additionally a pigment.

10. A heat sensitive recording material according to claim 4 wherein an undercoat layer is inserted between the carrier and the heat sensitive recording layer.

11. An aqueous dispersion obtained by atomized dispersing into water of the developer composition according to claim 1.

12. A developer composition comprising one or more compounds represented by the formula (1)

(1)

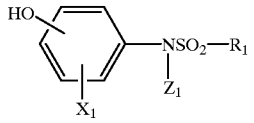

wherein $X_1$ is a hydrogen or halogen atom, an alkyl, alkoxy or hyrdroxyl group, $Z_1$ is a hydrogen atom or alkyl group, and $R_1$ is an unsubstituted or substituted alkyl or aryl group, and one or more constituents selected from a polyvalent metal compound.

13. A developer composition according to claim 12 wherein the composition comprises 0.1 to 5 parts by weight of one or more constituents selected from a polyvalent metal compound for 100 parts by weight of one or more compounds represented by the formula (1).

14. A developer composition according to claim 13 wherein the polyvalent metal compound is zinc sulfate.

15. A heat sensitive recording material equipped on a carrier with a heat sensitive recording layer comprising an electron donative, color forming compound and an electron acceptor compound wherein said electron acceptor compound is a developer composition according to claim 14.

16. A heat sensitive recording material according to claim 15 wherein the heat sensitive recording layer comprises additionally a heat fusible compound.

17. A heat sensitive recording material according to claim 16 wherein the heat sensitive recording layer comprises additionally an ultraviolet absorber.

18. A heat sensitive recording material according to claim 17 wherein the heat sensitive recording layer comprises additionally a hindered phenol compound.

19. A heat sensitive recording material according to claim 18 wherein the heat sensitive recording layer comprises additionally a binder.

20. A heat sensitive recording material according to claim 19 wherein the heat sensitive recording layer comprises additionally a pigment.

21. A heat sensitive recording material according to claim 20 wherein an undercoat layer is inserted between the carrier and the heat sensitive recording layer.

22. An aqueous dispersion obtained by atomized dispersing into water of the developer composition according to claim 14.

23. A developer composition according to claim 12 wherein the polyvalent metal compound is zinc sulfate.

24. A heat sensitive recording material equipped on a carrier with a heat sensitive recording layer comprising an electron donative, color forming compound and an electron acceptor compound wherein said electron acceptor compound is a developer composition according to claim 12.

25. A heat sensitive recording material according to claim 24 wherein the heat sensitive recording layer comprises additionally a heat fusible compound.

26. A heat sensitive recording material according to claim 24 wherein the heat sensitive recording layer comprises additionally an ultraviolet absorber.

27. A heat sensitive recording material according to claim 24 wherein the heat sensitive recording layer comprises additionally a hindered phenol compound.

28. A heat sensitive recording material according to claim 24 wherein the heat sensitive recording layer comprises additionally a binder.

29. A heat sensitive recording material according to claim 24 wherein the heat sensitive recording layer comprises additionally a pigment.

30. A heat sensitive recording material according to claim 24 wherein an undercoat layer is inserted between the carrier and the heat sensitive recording layer.

31. An aqueous dispersion obtained by atomized dispersing into water of the developer composition according to claim 12.

* * * * *